US008590149B2

(12) United States Patent
Meisborn et al.

(10) Patent No.: US 8,590,149 B2
(45) Date of Patent: Nov. 26, 2013

(54) METHOD OF MANUFACTURING A LIFT TRANSMITTING COMPONENT

(75) Inventors: Marco Meisborn, Hochstadt a.d. Aisch (DE); Peter Kares, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 806 days.

(21) Appl. No.: 12/687,402

(22) Filed: Jan. 14, 2010

(65) Prior Publication Data

US 2011/0005073 A1 Jan. 13, 2011

(30) Foreign Application Priority Data

Jul. 8, 2009 (DE) ..... 10 2009 032 143

(51) Int. Cl.
*F01L 1/18* (2006.01)
*F16C 35/06* (2006.01)

(52) U.S. Cl.
USPC ..... 29/888.03; 29/50; 29/509; 29/512; 29/898.13; 29/522.1; 403/242; 72/466.5; 123/90.41; 148/906; 148/572; 148/643

(58) Field of Classification Search
USPC ..... 29/888.03, 505, 509, 512, 243.517, 29/898.3, 898.13, 522.1, 524, 243.5, 29/243.518, 243.53; 403/203, 241, 242, 403/247, 248; 72/470, 466.4, 466.5; 123/90.41, 90.43; 384/449; 148/906, 148/572, 643, 644
See application file for complete search history.

(56) References Cited

U.S. PATENT DOCUMENTS

| | | | | | |
|---|---|---|---|---|---|
| 264,502 | A | * | 9/1882 | Woolson | 411/506 |
| 1,228,239 | A | * | 5/1917 | Phillips | 411/507 |
| 2,033,361 | A | * | 3/1936 | Taylor et al. | 403/157 |
| 3,444,606 | A | * | 5/1969 | Jones | 29/243.517 |
| 3,561,102 | A | * | 2/1971 | Diemer | 29/509 |
| 3,639,961 | A | * | 2/1972 | Shiflet | 29/898.044 |
| 3,874,070 | A | * | 4/1975 | Falcioni | 29/525.06 |
| 3,933,025 | A | | 1/1976 | Briles | |
| 3,952,401 | A | | 4/1976 | Wagner | |

(Continued)

FOREIGN PATENT DOCUMENTS

| | | |
|---|---|---|
| DE | 102006054406 | 5/2008 |
| EP | 1 609 960 | 12/2005 |
| GB | 2 233 418 | 1/1991 |
| WO | 2008 068116 | 6/2008 |

*Primary Examiner* — David Bryant
*Assistant Examiner* — Jason L Vaughan
(74) *Attorney, Agent, or Firm* — Volpe and Koenig, P.C.

(57) ABSTRACT

A method of manufacturing a lift transmitting component (2), particularly for a gas exchange valve train or a fuel pump drive of an internal combustion engine (1), is provided, The lift transmitting component includes a housing (6), a bearing pin (7) fixed in a reception bore (9) of the housing (6) and a roller (8) mounted through a sliding or a rolling bearing on the bearing pin (7). The bearing pin is core-hardened over an entire axial length to a core hardness of at least 650 HV, and pin ends (10) of the core-hardened bearing pin are radially widened relative to the reception bore for enabling a connection of the bearing pin to the housing (6) through positive engagement. The hardness of the bearing pin is at the most 780 HV, the radial widening of one of the pin ends being realized with a shaping die (11) which travels axially parallel to the bearing pin (7) and applies a force to the pin end in a transition region between a periphery and a front end surface of the bearing pin.

5 Claims, 1 Drawing Sheet

(56) References Cited

U.S. PATENT DOCUMENTS

| | | | | | |
|---|---|---|---|---|---|
| 3,956,801 | A | * | 5/1976 | Wood | 29/725 |
| 4,133,096 | A | * | 1/1979 | Falcioni | 29/524.1 |
| 4,628,874 | A | | 12/1986 | Barlow | |
| 4,871,268 | A | * | 10/1989 | Furumura et al. | 384/492 |
| 5,099,807 | A | | 3/1992 | Devine | |
| 5,375,323 | A | * | 12/1994 | Sata | 29/888.1 |
| 5,385,124 | A | | 1/1995 | Hillebrand et al. | |
| 7,793,583 | B2 | | 9/2010 | Radinger et al. | |
| 8,328,959 | B2 | | 12/2012 | Engelhardt et al. | |
| 2007/0006944 | A1 | * | 1/2007 | Waseda et al. | 148/320 |

* cited by examiner

METHOD OF MANUFACTURING A LIFT TRANSMITTING COMPONENT

CROSS-REFERENCE TO RELATED APPLICATIONS

This application claims the benefit of German patent application DE 10 2009 032 143.8, filed Jul. 8, 2009, which is incorporated herein by reference as if fully set forth.

BACKGROUND

The invention concerns a method of manufacturing a lift transmitting component, particularly for a gas exchange valve train or a fuel pump drive of an internal combustion engine, with the lift transmitting component comprising a housing, a bearing pin fixed in a reception bore of the housing and a roller mounted through a sliding or a rolling bearing on the bearing pin, with the bearing pin being core-hardened over an entire axial length to a core hardness of at least 650 HV (Vickers hardness), and pin ends of the core-hardened bearing pin being radially widened relative to the reception bore for enabling a connection of the bearing pin to the housing through positive engagement.

A lift transmitting component configured as a roller tappet for activating a tappet push rod of a gas exchange valve of an internal combustion engine with a bottom camshaft is known from U.S. Pat. No. 5,099,807. The roller tappet comprises a cam-activated roller, mounted through a rolling bearing on a bearing pin that is fixed through radially widened pin ends both by positive engagement and by force-locking in a reception bore of the tappet housing. The radial deformation of the pin ends is effected by gyratory swaging or calking and the calked material of the bearing pin is displaced in the form of a circular ring into a chamfer at the opening of the reception bore.

An alternative manner of fixing the bearing pin in the housing is disclosed, for example, in U.S. Pat. No. 4,628,874. In addition to a roller tappet, this document also discloses a lift transmitting component configured as a roller finger lever. In both cases, the bearing pin for the roller is fixed in the reception bore of the housing concerned by the fact that the material of the front ends of the bearing pin is displaced by a calking method radially outwards into a circumferential undercut situated within the reception bore.

Undercuts of the aforesaid type are also proposed for a roller tappet disclosed in U.S. Pat. No. 5,385,124. However, these undercuts do not serve to receive calked material of the bearing pin but for the reception of circlips that serve as positive engagement axial stops for the non-deformed pin ends of a bearing pin that is float-mounted in the reception bore.

A common feature of all the lift transmitting components proposed in the cited documents is that, with the aim of achieving wear resistance, their bearing pins are hardened in the region of their roller raceways. But if a bearing pin is calked, it is imperative for its front ends to be adequately soft in view of the material flow that is concomitant with the swaging or calking process. Such a bearing pin with non-uniform hardness values along its length, however, can only be realized through complex and, thus, cost-intensive heat treating methods. A further drawback of a bearing pin whose ends have only a low hardness arises from the fact that its calked pin ends must be fixed in the reception bore not only by positive engagement but also by force-locking. The reason for this is that the soft pin ends of a bearing pin that is not fixed by force-locking in the reception bore and is made to rotate by the friction forces of the rotating roller, could be subjected to contact friction with the housing on their periphery, so that they could suffer a loss of their axial securing function and thus shear off. A fixing of the bearing pin in the reception bore not only by positive engagement but also substantially by force-locking can pose a problem in cases in which the housing of the lift transmitting component has to meet special shape requirements as is the case with the initially cited cylindrical roller tappets. As a rule, these roller tappets are mounted in their longitudinal guides with a guide lash of just a few micrometers, so that a deformation of the housing, generally configured with thin walls in the region of the roller, would lead to an impermissibly large non-circularity of the housing due to the radially widened reception bore resulting from the calking of the bearing pin.

As proposed in the cited document U.S. Pat. No. 5,385,124, it is certainly possible to circumvent this chain of drawbacks by using an axially uniformly core-hardened bearing pin whose front ends are not deformed and which is float-mounted in its reception bore while being fixed axially through positive engagement by circlips. Although the bearing pin can be economically manufactured with regard to the simplified heat treatment, there still remains, even in this case, a cost-increasing extra expenditure for the circlips and their assembly as well as for making the undercuts in the housing for receiving the circlips.

A method of the pre-cited type in which the bearing pin is widened at its ends in a completely core-hardened state for fixing it by positive engagement in the housing is known from the document DE 10 2006 054 406 A1 which is considered to be species-defining. In this method known under the name of radial spot riveting, the radial widening of the pin ends is effected through a riveting die whose longitudinal axis traverses a loop line wobbling within a circular cone which is concentric to the bearing pin. Due to the high contact forces, the material of the front ends of the bearing pin is successively deformed in the course of the wobbling movement. An important drawback of this method, however, results from the comparatively long working time which is required for traversing the loop line and thus counteracts short cycle times for manufacturing the lift transmitting component.

SUMMARY it is therefore an object of the invention to provide an improved method of the pre-cited type for manufacturing a lift transmitting component with which the aforesaid drawbacks are eliminated by implementation of simple measures. It is a further object to reduce, as much as possible, the working time required for deforming the core-hardened pin ends.

These and other objects and advantages of the invention will become obvious from the following detailed description.

The invention achieves the above objects by the fact that the hardness of the bearing pin is at the most 780 HV, the radial widening of one of the pin ends is realized with help of a shaping die which travels axially parallel to the bearing pin and applies a force to the pin end in a transition region between a periphery and a front end surface of the bearing pin.

Tests carried out by the applicant have surprisingly shown that an adequate radial deformation of the pin ends for achieving the required locking by positive engagement is possible even in this upper hardness range and can be realized substantially without material spalling or cracking even if the shaping die travels in a straight line and axially parallel to the bearing pin and deforms all contact points on the pin ends simultaneously, as is basically the case in the calking of soft pin ends. The invention thus combines the advantageously short working and cycle times of calking of soft pin ends with the advantageously low manufacturing costs of uniformly core-hardened bearing pins.

According to a further development of the invention, the shaping die comprises a recess that receives the pin ends and contacts the transition region between the periphery and the front end surface of the bearing pin following a circular or a circular arc-shaped path. During calking of the bearing pin, in contrast, the soft pin end is radially deformed by the fact that its front end surface is stamped, common stamping geometries in this case being circular or circular arc-shaped grooves on the front end surface of the pin end. The recess is preferably shaped such that its diameter decreases continuously in direction of its bottom. In particular, the recess should have the shape of a circular frustum of a cone or of a spherical segment.

Moreover, the non-widened diameter of the bearing pin should be smaller than the diameter of the reception bore. Because the bearing pin thus has radial lash and because it is fixed in the reception bore of the housing, in this case, only by positive engagement, there is no radial force application on the reception bore, so that it is possible not only to guarantee a high stability of shape of the housing but also to do without a special fitting or surface quality of the reception bore in favor of lower production costs. Moreover, the radial lash permits an autorotation of the bearing pin relative to the reception bore for the benefit of a uniform surface loading in the region of the roller, so that safety from surface wear in the contact region between the bearing pin and the roller, including any rolling elements that may be used, is further improved.

As an alternative to the radial lash or additionally thereto, it can also be advantageous with a view to obtaining a high stability of shape of the housing, to fix the bearing pin with axial lash in the reception bore. In this case, a deformation of the housing due to axially acting chucking forces between the front ends of the bearing pin can be prevented. A fixing of the bearing pin solely by positive engagement with a view to assuring a stability of shape of the housing is particularly advantageous if the housing is configured with a substantially cylindrical shape and, for example, as a thin-walled pump tappet of a high pressure fuel pump for an internal combustion engine with direct fuel injection.

As an alternative to the embodiments described above, the invention further includes a fixing of the bearing pin without axial lash and/or without radial lash in the reception bore. In the case of a radial lash-free fixing, the bearing pin—except in the limiting case of a close sliding fit in the reception bore—would be connected to the housing not only by positive engagement but also force-locked to the housing through an interference fit.

BRIEF DESCRIPTION OF THE DRAWINGS

Further features of the invention will become apparent from the following description and the appended drawings which illustrate one exemplary embodiment of the invention. If not otherwise stated, identical or similar functional features or components are designated by identical reference numerals. The figures show, partially in strongly simplified form.

DETAILED DESCRIPTION OF THE PREFERRED EMBODIMENTS

Figure 3:
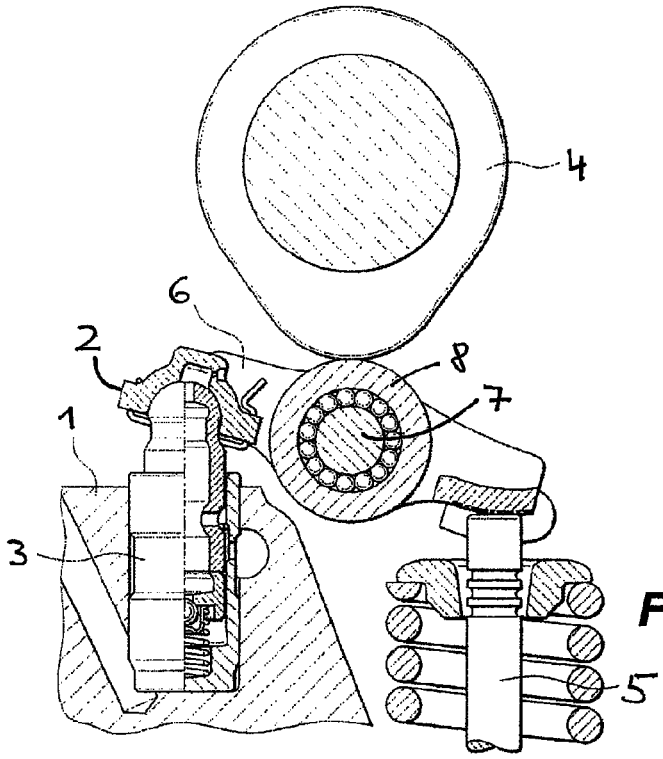
FIG. 3, a finger lever valve train of a type known per se.

The method of the invention for making a lift transmitting component will be explained starting from FIG. 3 which shows, in a sectional view, a part of a finger lever valve train, known per se, of an internal combustion engine 1. In this preferred case of use, the lift transmitting component 2 is configured as a large series finger lever which is pivotally mounted with one end on a support element 3 and transmits the lift of a cam 4 to a gas exchange valve 5 through the other end. The finger lever 2 comprises a housing which, in the present case is configured in the form of a lever body which is symmetric to the central longitudinal axis of the finger lever and comprises two parallel side walls 6 spaced from each other and comprising aligned reception bores, and said finger lever 2 further comprises a bearing pin 7 fixed in the reception bores and a roller 8 which is mounted through a needle roller bearing on the bearing pin 7 and thus takes over the lift of the cam 4 with low friction. The bearing pin 7 is core-hardened over its entire axial length and possesses a core hardness in the range of 650 HV to 780 HV (Vickers hardness).

Figure 1:
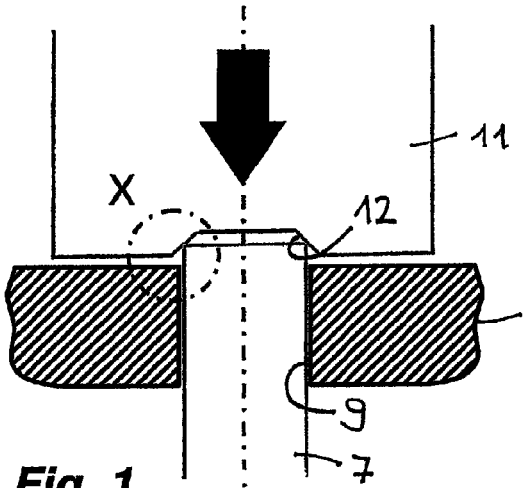
FIG. 1, a non-deformed bearing pin and a shaping die applied to the bearing pin.
Figure 2:
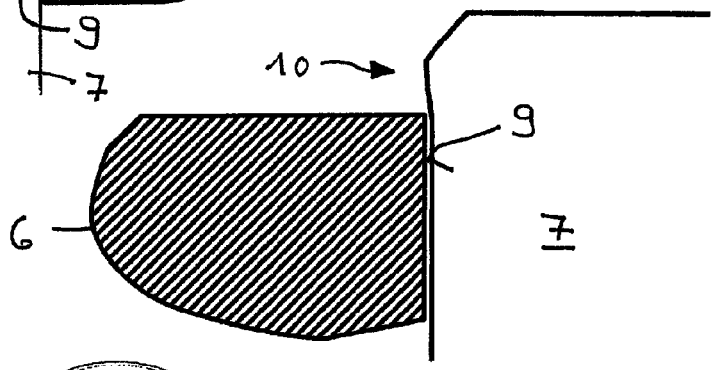
FIG. 2, the contour of a deformed pin end as a detail X of FIG. 1.

The shaping method for fixing the bearing pin 7 in the reception bores 9 is sketched in FIGS. 1 and 2 in which the pin head 10 protruding beyond both reception bores 9 is represented respectively before and after radial widening through a shaping die 11. The shaping or stamping die 11 travels in a direction parallel to the longitudinal axis of the bearing pin 7, as graphically indicated by the arrow, and comprises a recess 12 in the form of a circular frustum of a cone opening towards the bearing pin 7 for receiving the pin end 10 and circularly contacting the transition region between the periphery and the front end surface of the bearing pin 7 under maximum loading. The deformation of the pin end 10 illustrated in FIG. 2 which, by reason of the radial widening of the pin end 10 leads to a positive engagement connection of the bearing pin 7 to the two side walls 6, is achieved already after one single loading operation of the bearing pin 7 through the shaping die 11.

The connection thus obtained is effective solely be positive engagement because, on the one hand, the bearing pin 7 is fixed in the reception bores 9 with perceptible axial lash and, on the other hand, the non-widened diameter of the bearing pin 7 is smaller than the diameter of the reception bores 9, so that, as a result of the thus formed radial lash, no force-locked connection exists in the reception bores 9.

LIST OF REFERENCE NUMERALS

1 Internal combustion engine
2 Lift transmitting component/finger lever
3 Support element
4 Cam
5 Gas exchange valve
6 Housing/side wall
7 Bearing pin
8 Roller
9 Reception bore
10 Pin end
11 Shaping die
12 Recess of the shaping die

The invention claimed is:

1. A method of manufacturing a lift transmitting component for a gas exchange valve train or a fuel pump drive of an internal combustion engine, the lift transmitting component comprising a housing, a bearing pin fixed in a reception bore of the housing and a roller mounted with a sliding or a rolling bearing on the bearing pin, the method comprising:

core hardening the bearing pin over an entire axial length to a core hardness of at least 650 HV and the hardness of the bearing pin is at the most 780 HV; and radially widening pin ends of the core-hardened bearing pin relative to the reception bore to provide a connection of the bearing pin to the housing through positive engagement, the radial widening of one of the pin ends is realized via a shaping die which travels axially parallel to the bearing pin and applies a force to the pin end in a transition region between a periphery and a front end surface of the bearing pin.

2. Method according to claim 1, wherein the shaping die comprises a contact surface that includes a recess for receiving the pin end and the contact surface contacts the transition region between the periphery and the front end surface of the bearing pin following a circular or a circular arc-shaped path.

3. Method according to claim 2, wherein a diameter of the recess decreases gradually in an axial direction extending away from an axial end of the shaping die.

4. Method according to claim 1, wherein a non-widened diameter of the bearing pin is smaller than a diameter of the reception bore.

5. Method according to claim 1, wherein the bearing pin is fixed in the reception bore with axial lash.

* * * * *